US005195834A

United States Patent [19]

Matsuo

[11] Patent Number: 5,195,834

[45] Date of Patent: Mar. 23, 1993

[54] INK RIBBON CASSETTE

[75] Inventor: Naotoshi Matsuo, Chiba, Japan

[73] Assignee: Hitachi Powdered Metals Co., Ltd., Chiba, Japan

[21] Appl. No.: 741,358

[22] Filed: Aug. 7, 1991

[30] Foreign Application Priority Data

Aug. 10, 1990 [JP] Japan ..... 2-213526

[51] Int. Cl.[5] ..... B41J 27/12

[52] U.S. Cl. ..... 400/202; 400/202.4; 400/176.1

[58] Field of Search ..... 400/202, 196.1, 202.2, 400/200, 202.4, 197

[56] References Cited

U.S. PATENT DOCUMENTS

| | | | |
|---|---|---|---|
| 4,322,172 | 3/1982 | Furrow | 400/202.4 |
| 4,493,572 | 1/1985 | Van Ocker et al. | 400/202 |
| 4,536,098 | 8/1985 | Sheehan et al. | 400/202 |
| 4,636,097 | 1/1987 | Goubeaux | 400/196.1 |
| 5,059,045 | 10/1991 | Mrvos et al. | 400/202.4 |

FOREIGN PATENT DOCUMENTS

| | | | |
|---|---|---|---|
| 167892 | 1/1986 | European Pat. Off. . | |
| 2544666A | 10/1984 | France | 400/202.4 |
| 59-169879 | 9/1984 | Japan | 400/202 |
| 60-11383 | 1/1985 | Japan | 400/202.4 |
| 62-248677 | 10/1987 | Japan | 400/202 |

*Primary Examiner*—Edgar S. Burr
*Assistant Examiner*—Anthony H. Nguyen
*Attorney, Agent, or Firm*—Sandler Greenblum & Bernstein

[57] ABSTRACT

An ink ribbon cassette for use in an office machine comprises: an inking roll impregnated with ink; a ribbon-drive roll for driving an ink ribbon; and a ribbon-driven roll driven by the ink ribbon. The ink is transferred from the inking roll to the ink ribbon through any one of the ribbon-drive and said ribbon-driven roll, which one is pressed against the inking roll so as to be brought into a slidable contact with the same. In the ink ribbon cassette, the improvement resides in that: the ink ribbon cassette further comprises a spring. The spring has its contact portion brought into a resilient contact with an outer peripheral surface of the inking roll so as to urge the same against any one of the ribbon-drive and the ribbon-driven roll, so that the ink impregnated in the inking roll is constantly supplied to the ink ribbon in printing.

2 Claims, 3 Drawing Sheets

FIG.3
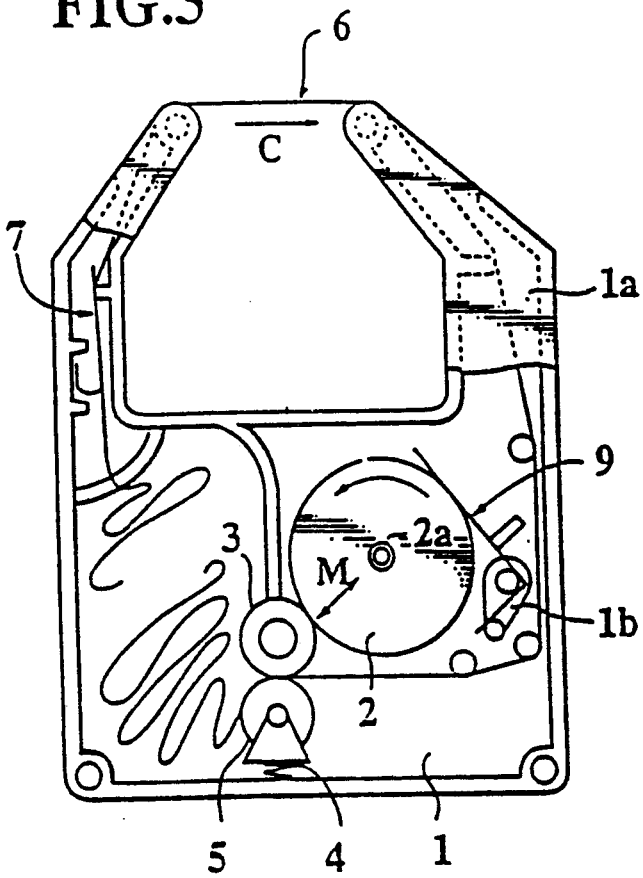
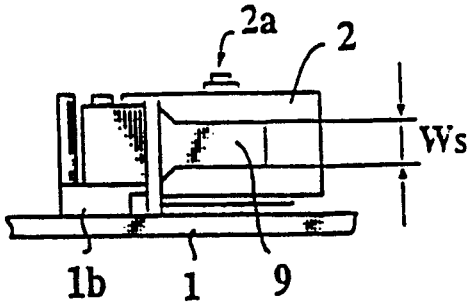
FIG.4
FIG.5
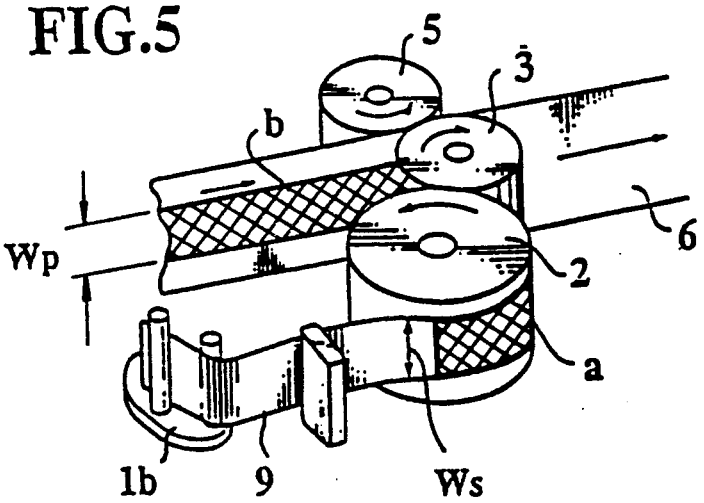
FIG.6
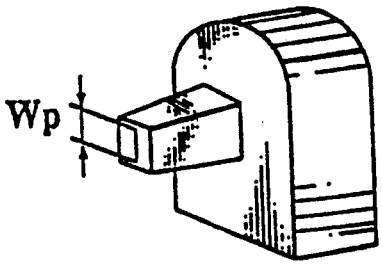

INK RIBBON CASSETTE

BACKGROUND OF THE INVENTION

1. Field of the Invention

The present invention relates to an ink ribbon cassette for use in a printing system of an office machine such as typewriters and printers, and more particularly to an ink ribbon cassette which is free from tension variation in ink ribbon, and, therefore free from variation in supply rate of ink being fed to the ink ribbon, and enables the user to use ink (impregnated in an inking roll of the cassette) substantially without making any waste.

2. Description of the Prior Art

Heretofore, it is known to provide, in a printing system of an office machine such typewriters and printers, an ink ribbon cassette having a construction as shown in FIG. 1 so as to permit an ink ribbon housed therein to be used for a long period of time in printing.

More particularly, as shown in FIG. 1, in the above conventional ink ribbon cassette, an inking roll 2 impregnated with ink is housed in a cassette case 1. Also housed in the cassette case 1 is a ribbon-drive roll 3 which is rotatably driven clockwise by a cassette drive shaft of a printer (not shown). On the other hand, in the cassette case 1, a ribbon-driven roll 5 is resiliently pressed against the ribbon-drive roll 3 by means of a compression spring 4, and, therefore the roll 5 is rotatably driven counterclockwise by the ribbon-drive roll 3 through an ink ribbon 6 which is so sandwiched therebetween as to be driven in a direction "A" when the ribbon-drive roll 3 is rotatably driven clockwise.

On the other hand, as is clear from FIG. 1, a tension spring 7 is so housed in the cassette case 1 as to give the ink ribbon 6 a predetermined amount of tension. Consequently, under the influence of such tension of the ink ribbon 6, an ink transfer roll 8 which is movable in a direction L is resiliently pressed against the inking roll 2 slightly deform the inking roll 2. As a result, when the ribbon-drive roll 3 is driven clockwise, the ink transfer roll 8 and the inking roll 2 are rotatably driven clockwise and counterclockwise respectively by the ink ribbon 6, as shown in FIG. 1.

As a result, in printing operation, the thus deformed inking roll 2 releases its ink (impregnated therein) therefrom and transfers it to the ink transfer roll 8 to permit the same 8 to further transfer or supply the ink to the ink ribbon 6.

However, in the conventional ink ribbon cassette having the above construction, since the inking roll 2 is deformed through the ink transfer roll 8 which is urged against the inking roll 2 only under the influence of the tension of the ink ribbon 6 caused by the tension spring 7, a deformation rate of the inking roll 2 depends on variation in tension of the ink ribbon 6, which makes it difficult to keep a supply rate of the ink (being supplied to the ink ribbon 6) constant. Such variation in tension of the ink ribbon 6 tends to increase in printing operation due to damages of the ink ribbon 6 caused in a printing head section of the office machine, which increases variation of the supply rate of ink being supplied to the ink ribbon 6. Consequently, it is very difficult for the conventional ink ribbon cassette to realize a high-quality printing.

In order to resolve the above problem, another conventional ink ribbon cassette has been proposed, which cassette has a construction shown in FIG. 2. In this another conventional ink ribbon cassette, as in the above conventional ink ribbon cassette, the inking roll 2 impregnated with ink is rotatably mounted in the cassette case 1; the ribbon-drive roll 3 is rotatably driven clockwise by a cassette drive shaft of a printer (not shown); the ribbon-driven roll 5 is resiliently pressed against the ribbon-drive roll 3 by means of the compression spring 4 so as to be rotatably driven counterclockwise by the ribbon-drive roll 3 in printing operation; and the ink ribbon 6 is sandwiched between the ribbon-drive 3 and the ribbon-driven 5 roll so as to be driven in a direction "B" when the ribbon-drive roll 3 is driven.

In the printing operation, the inking roll 2 is brought into a pressure contact with the ribbon-drive roll 3 so as to be rotated on its rotary shaft 2a, so that the inking roll 2 is slightly deformed by the ribbon-drive roll 3 while rotatably driven by the ribbon-drive roll 3. The thus deformed inking roll 2 releases the ink impregnated therein, and transfers it to the ribbon-drive roll 3 to enable the ribbon-drive roll 3 to supply the ink to the ink ribbon 6.

As is clear from the above description, in the above another conventional ink ribbon cassette, since the inking roll 2 is deformed only by the ribbon-drive roll 3 but not deformed under the influence of the tension of the ink ribbon 6, there is no fear that the supply rate of the ink being supplied from the inking roll 2 to the ink ribbon 6 varies, depending on variation in tension of the ink ribbon 6.

However, the another conventional ink ribbon cassette is disadvantageous in that only a part of ink impregnated in a surface portion of the inking roll 2 is transferred to the ink ribbon 6 through the ribbon-drive roll 3 so as to be used in printing (in other words, most of ink impregnated in the remaining portion of the inking roll 2 can not be transferred to the ink ribbon 6 through the ribbon-drive roll 3, and, therefore can not be used in printing).

SUMMARY OF THE INVENTION

In view of such circumstances, the present invention was made. Therefore, it is an object of the present invention to provide an ink ribbon cassette which is free from tension variation in ink ribbon, and, therefore free from variation in supply rate of ink being fed to the ink ribbon, and enables the user to use ink (impregnated in an inking roll of the cassette) substantially without making any waste.

The above object of the present invention is accomplished by providing:

an ink ribbon cassette for use in an office machine, comprising: an inking roll impregnated with ink; a ribbon-drive roll for driving an ink ribbon; and a ribbon-driven roll driven by the ink ribbon, the ink being transferred from the inking roll to the ink ribbon through any one of the ribbon-drive and the ribbon-driven roll, which one is pressed against the inking roll so as to be brought into a slidable contact with the inking roll, wherein:

the ink ribbon cassette further comprises a spring means which has its contact portion brought into a resilient contact with an outer peripheral surface of the inking roll so as to urge the inking roll against any one of the ribbon-drive and the ribbon-driven roll.

In the ink ribbon cassette of the invention having the above construction, the spring means is brought into a direct contact with the inking roll to resiliently urge the same against any one of the ribbon-drive and the ribbon-driven roll, so that the above object of the present invention is accomplished.

BRIEF DESCRIPTION OF THE DRAWINGS

FIG. 3 is a partially broken plan view of the ink ribbon cassette of the present invention;

FIG. 4 is a side view of an embodiment of the assembly of the inking roll and spring means of the ink ribbon cassette of the present invention shown in FIG. 3;

FIG. 5 is a perspective view of the embodiment of the assembly of the inking roll and the spring means of the ink ribbon cassette of the present invention shown in FIG. 3;

FIG. 6 is a perspective view of a printing head of the office machine in which the ink ribbon cassette of the present invention is used.

DESCRIPTION OF THE PREFERRED EMBODIMENTS

Figure 1:
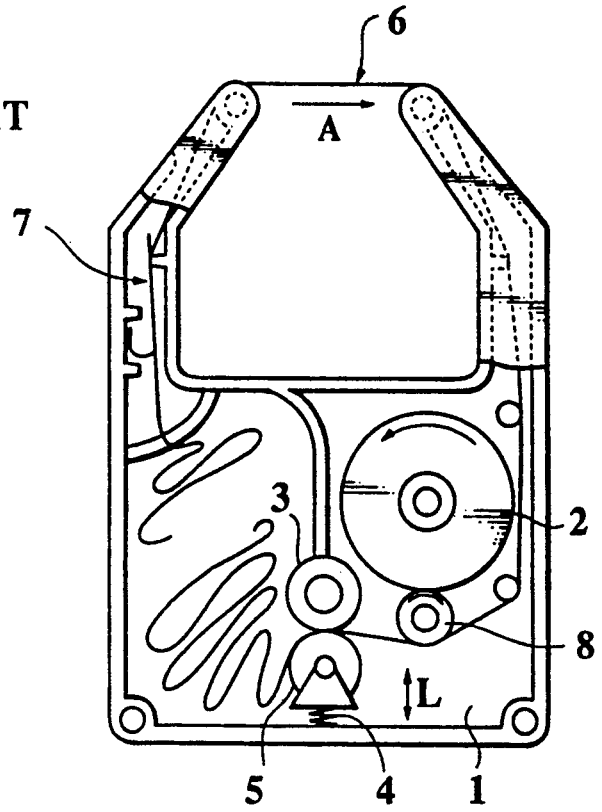
FIG.1 PRIOR ART
FIG. 1 is a partially broken plan view of the conventional ink ribbon cassette.
Figure 2:
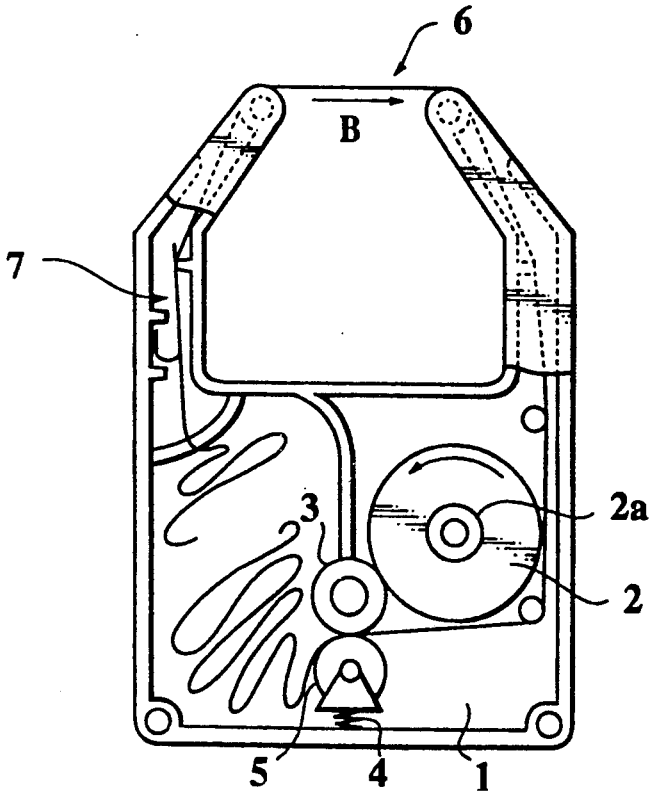
FIG.2 PRIOR ART
FIG. 2 is a partially broken plan view of the another conventional ink ribbon cassette.

Hereinbelow, the present invention will be described in detail with reference to the accompanying drawings in which; an ink ribbon cassette of the present invention is shown to be used in a wire dot printer section of an office machine; and, like reference numerals apply to similar parts throughout several views.

FIG. 3 is a partially broken plan view of an embodiment of an ink ribbon cassette of the present invention. As shown in FIG. 3, a cassette case 1 of the ink ribbon cassette of the present invention is covered with a cassette cover 1*a* (an assembly of the cassette case 1 and the cassette cover 1*a* is hereinafter referred to simply as the cassette 1, 1*a*)

On the other hand, an inking roll 2 is rotatably mounted in the cassette 1, 1*a*. In printing operation, the inking roll 2 turns on its rotary shaft 2*a*. The rotary shaft 2*a* of the inking roll 2 assumes a sleeve-like shape, and is movably mounted in the cassette 1, 1*a* so as to move in the directions of double arrow M in printing operation. Namely, the rotary shaft 2*a* of the inking roll 2 is slidably mounted in a pair of elongated holes (not shown) formed in the cassette 1, 1*a*, which pair of the elongated holes (not shown) extend in parallel to each other in the directions of the double arrow M.

A ribbon-drive roll 3 is rotatably mounted in the cassette 1, 1*a*, while rotatably driven clockwise by a cassette drive shaft (not shown) of a printer of an office machine in printing operation, as viewed in FIG. 3. With this ribbon-drive roll 3, the inking roll 2 is brought into a slidable and pressure contact under the influence of a resilient force exerted by a spring means 9, an end of which is fixedly supported by a supporting member 1*b* which is fixedly mounted in the cassette 1, 1*a*. Consequently, in printing operation, the inking roll 2 is slightly deformed by the ribbon-drive roll 3, while rotatably driven by the ribbon-drive roll 3.

On the other hand, a ribbon-driven roll 5 is rotatably mounted in the cassette 1, 1*a*, while resiliently urged against the ribbon-drive roll 3 under the influence of a resilient force exerted by a compression spring 4. Consequently, the ribbon-driven roll 5 is brought into a slidable/pressure contact with the ribbon-drive roll 3, and rotatably driven by the same roll 3 through an ink ribbon 6 (which is sandwiched between the ribbon-drive roll 3 and the ribbon-driven roll 5). As a result, the ink ribbon 6 is driven in a direction C by the ribbon-drive roll 3 in printing operation. A tension spring 7 is so mounted in the cassette 1, 1*a* as to impart a predetermined amount of tension to the ink ribbon 6.

On the other hand, the spring means 9 (which has one of its opposite ends fixedly mounted in the cassette 1, 1*a* through the supporting member 1*b*) has the other of its opposite ends brought into a direct contact with an outer peripheral portion of the inking roll 2 so as to resiliently urge the inking roll 2 against the ribbon-drive roll 3, so that the inking roll 2 is brought into a slidable/-pressure contact with the ribbon-drive roll 3 to have its outer peripheral portion slightly deformed by the ribbon-drive roll 3, whereby the inking roll 2 is permitted to release the ink (impregnated in the inking roll 2), which ink is then transferred or supplied to the ink ribbon 6 through the ribbon-drive roll 3 in printing operation.

Essential parts of the ink ribbon cassette of the present invention are shown in FIGS. 4 and 5. As is clear from FIGS. 4 and 5, the spring means 9 has its contact portion brought into a resilient contact with the outer peripheral surface of the inking roll 2 so as to urge the inking roll 2 against the ribbon-drive roll 3. The above contact portion of the spring means 9 has a width Ws which is substantially equal to a width Wp of a printing area or wire array of printing head (shown in FIG. 6) of an office machine. Consequently, as is clear from FIG. 5, in an area "a" of the outer peripheral surface of the inking roll 2, the ink impregnated in the inking roll 2 is sufficiently released from the roll 2, and transferred to an area "b" of the ink ribbon 6 through the ribbon-drive roll 3 to make it possible to sufficiently supply the ink to the ink ribbon 6 in printing operation, the area "a" being substantially equal in width to the area "b". Incidentally, in the present invention, it is also possible that the width Ws of the contact portion of the spring means 9 is exactly equal to the width Wp of the printing area or wire array of the printing head (shown in FIG. 6) of the office machine.

In the above embodiment of the ink ribbon cassette of the present invention having the above construction, since one of the opposite ends of the spring means 9 is brought into a direct contact with the inking roll 2 so as to impart a resilient force exerted by the spring means 9 to the inking roll 2, the inking roll 2 is resiliently urged or pressed against the ribbon-drive roll 3 so as to be slightly deformed thereby, to make it possible to release the ink (impregnated in the inking roll 2) from the roll 2 so as to use it without making any waste. Consequently, in the above embodiment of the ink ribbon cassette of the present invention, there is no fear that the supply rate of the ink varies even when the tension of the ink ribbon varies in printing operation.

In addition, in the above embodiment of the present invention, since the width Ws of the contact portion of the spring means 9 is substantially equal to the width Wp of the printing area or wire array of the printing head (shown in FIG. 6) of the office machine, it is possible to supply the ink only to the printing area of the ink ribbon 6.

Incidentally, in the embodiment of the present invention, the ink ribbon cassette of the present invention is used in the wire dot printer of the office machine. However, it is also possible to use the ink ribbon cassette of the present invention in daisy-wheel printers, letter-type printers and like printers of the office machines.

Figure 7:
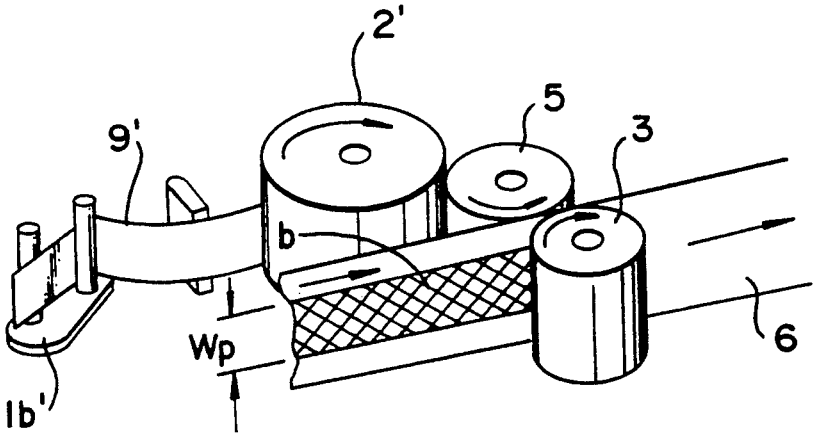
FIG. 7 is a perspective view of a second embodiment of the assembly of the present invention.

Further, in the above embodiment of the present invention, the inking roll 2 is brought into a direct contact with the ribbon-drive roll 3. However, it is also possible to have the inking roll 2 brought into a direct contact with the ribbon-driven roll 5, as shown in FIG. 7, which includes supporting member 1*b*′, inking roll 2′, and spring means 9′, in place of the ribbon-drive roll 3.

What is claimed is:

1. An ink ribbon cassette for use in an office machine, comprising:

an inking roll impregnated with ink;

a ribbon-drive roll for driving an ink ribbon;

a ribbon-driven roll driven by said ribbon-drive roll through said ink ribbon;

wherein said ink is transferred from said inking roll to said ink ribbon through said ribbon-drive roll, said ribbon-drive roll being pressed against said inking roll so as to be brought into a slidable contact with said inking roll; and leaf spring means having a width less than the width of said inking roll and which has a contact portion brought into a direct resilient contact with an outer peripheral surface of said inking roll so as to urge said inking roll against said ribbon-drive roll so that, in a printing operation, said inking roll is slightly deformed by said ribbon-drive roll, while being rotatably driven by said ribbon-drive roll;

wherein said contact portion of said spring means is equal in width to a printing area through which printing is made by a printing head of said office machine.

2. An ink ribbon cassette for use in an office machine, comprising:

an inking roll impregnated with ink;

a ribbon-drive roll for driving an ink ribbon;

a ribbon-driven roll driven by said ribbon-drive roll through said ink ribbon;

wherein said ink is transferred from said inking roll to said ink ribbon through said ribbon-driven roll, said ribbon-driven roll being pressed against said inking roll so as to be brought into a slidable contact with said inking roll; and leaf spring means having a width less than the width of direct resilient contact with an outer peripheral surface of said direct resilient contact with an outer peripheral surface of said inking roll so as to urge said inking roll against said ribbon-driven roll so that, in a printing operation, said inking roll is slightly deformed by said ribbon-driven roll, while being rotatably driven by said ribbon-driven roll;

wherein said contact portion of said spring means is equal in width to a printing area through which printing is made by a printing head of said office machine.

* * * * *

UNITED STATES PATENT AND TRADEMARK OFFICE

CERTIFICATE OF CORRECTION

PATENT NO. : 5,195,834
DATED : March 23, 1993
INVENTOR(S) : N. MATSUO

It is certified that error appears in the above-indentified patent and that said Letters Patent is hereby corrected as shown below:

Col. 1, line 38, insert --to-- after "2".

Col. 2, line 51, change "an" to --An--

At column 6, line 19 (claim 2, line 13) insert ---said inking roll and which has a contact portion brought into a-- after "width of".

At column 6, lines 20-21 (claim 2, lines 14-15) delete "direct resilient contact with an outer peripheral surface of said" after "surface of said".

Signed and Sealed this

Twelfth Day of April, 1994

Bruce Lehman

BRUCE LEHMAN

*Commissioner of Patents and Trademarks*

*Attest:*

*Attesting Officer*